US009049767B2

(12) United States Patent
Lai

(10) Patent No.: US 9,049,767 B2
(45) Date of Patent: Jun. 2, 2015

(54) ELECTRONIC CENSER WITH CONTROL SYSTEM HAVING WIND FORCE SENSOR TO REGULATE LIGHT EMITTING STATE THEREOF

(71) Applicant: HON HAI PRECISION INDUSTRY CO., LTD., New Taipei (TW)

(72) Inventor: Chih-Chen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 122 days.

(21) Appl. No.: 13/901,586

(22) Filed: May 24, 2013

(65) Prior Publication Data

US 2014/0167651 A1 Jun. 19, 2014

(30) Foreign Application Priority Data

Dec. 13, 2012 (TW) ..... 101147269 A

(51) Int. Cl.
*H05B 33/08* (2006.01)

(52) U.S. Cl.
CPC ..... *H05B 33/0854* (2013.01); *H05B 33/0845* (2013.01)

(58) Field of Classification Search
USPC ..... 315/158, 185 R, 291, 307, 308, 312
See application file for complete search history.

(56) References Cited

U.S. PATENT DOCUMENTS

2013/0110414 A1* 5/2013 Caponetti et al. ..... 702/35

* cited by examiner

*Primary Examiner* — Jimmy Vu
(74) *Attorney, Agent, or Firm* — Novak Druce Connolly Bove + Quigg LLP

(57) ABSTRACT

An exemplary electronic censer with control system includes a main body, an LED disposed on the main body and a control system mounted on the main body. The control system includes a driver received in the main body, a wind force sensor exposed out of the main body and a controlling unit electrically connecting the driver. The wind force sensor measures a wind force therearound and samples a wind force signal S corresponding to the measured wind force to the controlling unit. The controlling unit analyzes the wind force signal S and thereby delivers instructions to the driver to regulate a light emitting state of the LED. A method for controlling the electronic censer with control system is also provided.

17 Claims, 3 Drawing Sheets

ELECTRONIC CENSER WITH CONTROL SYSTEM HAVING WIND FORCE SENSOR TO REGULATE LIGHT EMITTING STATE THEREOF

BACKGROUND

1. Technical Field

The present disclosure generally relates to an electronic censer with a luminance control system having a wind force sensor to regulate a light emitting state of the electronic censer.

2. Description of the Related Art

Traditional censers are used for accommodating incenses, wherein each incense includes a rod made of bamboo and aromatic biotic materials coated on the rod. When the aromatic biotic materials are burned, a large amount of smoke is caused. The fired aromatic biotic material is easy to scald person. The smoke not only pollutes the environment, but also is harmful to health.

An electronic censer is used to replace the traditional censer. However, when the electronic censer is lighted, the electronic censer continuously emits light without instantaneously twinkling according to changes of winds outside. As such, the conventional electronic censor is not lifelike enough when compared with traditional censers.

Therefore, it is desirable to provide an electronic censer which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present Electronic censer with luminance control system. Moreover, in the drawings, all the views are schematic, and like reference numerals designate corresponding parts throughout the views.

DETAILED DESCRIPTION

Figure 1:
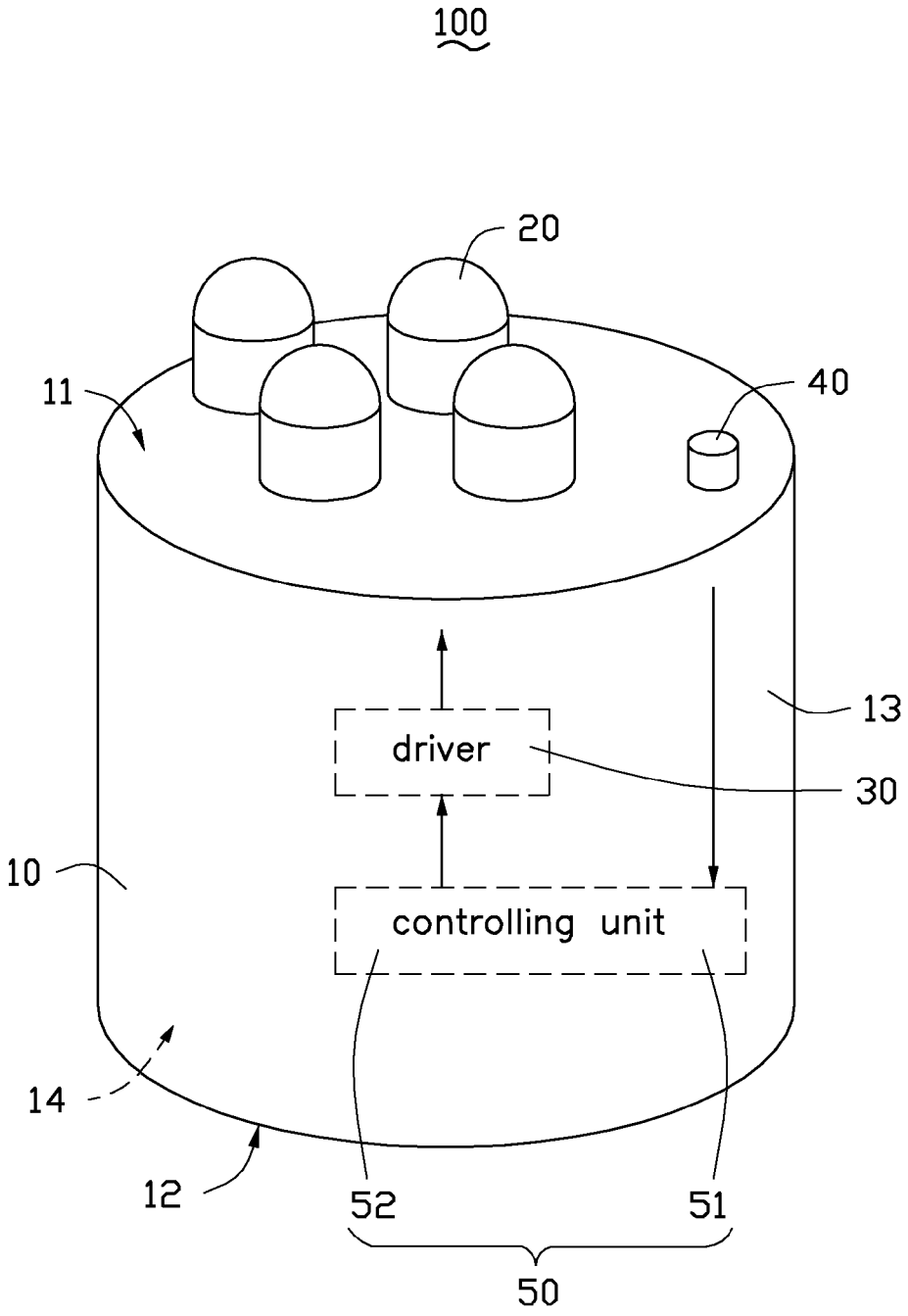
FIG. 1 is a schematic, assembled view of an electronic censer according to one embodiment of the present disclosure.

Referring to FIG. 1, an electronic censer 100 in accordance with a first exemplary embodiment is provided. The electronic censer 100 includes a main body 10, a plurality of LEDs 20 mounted on a top end of the main body 10, and a control system mounted on the main body 10 to regulate a luminance of the LEDs 20. The control system includes a driver 30, a wind force sensor 40 and a controlling unit 50. Each LED 20 functions as an incense which can produce red light at a tip thereof. Alternatively, the LED 20 can produce light having a color other than red at the tip thereof when required.

Specifically, the main body 10 is a hollow and cylindrical container. The main body 10 includes a top plate 11, a bottom plate 12 opposite to the top plate 11, and an annular sidewall 13 interconnecting the top plate 11 and the bottom plate 12. The top plate 11, the bottom plate 12 and the sidewall 13 are engaged together to cooperatively form a receiving space 14.

The top plate 11 is flat. Alternatively, the main body 10 can also have other shape, such as rectangular parallelepiped, triangular cylinder and so on.

In this embodiment, four LEDs 20 are mounted on the top plate 11 of the main body 10. The driver 30 is received in the receiving space 14. The driver 30 includes a circuit board (not shown) and a plurality of components disposed on the circuit board. The driver 30 electrically connects the LEDs 20 and drives the LEDs 20 to emit light.

The wind force sensor 40 is disposed on the top plate 11 of the main body 10 and exposed in ambient air. The wind force sensor 40 periodically measures instantaneous wind force of the environment and samples a corresponding wind force signal S to the controlling unit 50. In this embodiment, a measure period is ranged from five seconds to ten seconds. Alternatively, the wind force sensor can continuously measure the wind force of the environment. That is, the wind force signal S of every second can be continuously transferred to the controlling unit 50.

The controlling unit 50 is received in the receiving space 14 of the main body 10. The controlling unit 50 includes an input portion 51 and an output portion 52 connecting the input portion 51. The input portion 51 electrically connects with the wind force sensor 40 for receiving the wind force signal S and analyzing and comparing the wind force signal S relative to a scheduled signal. The output portion 52 electrically connects with the driver 30. The output portion 52 delivers instructions to the diver 30 according to the compared results to regulate the luminance of the LEDs 20.

Figure 2:
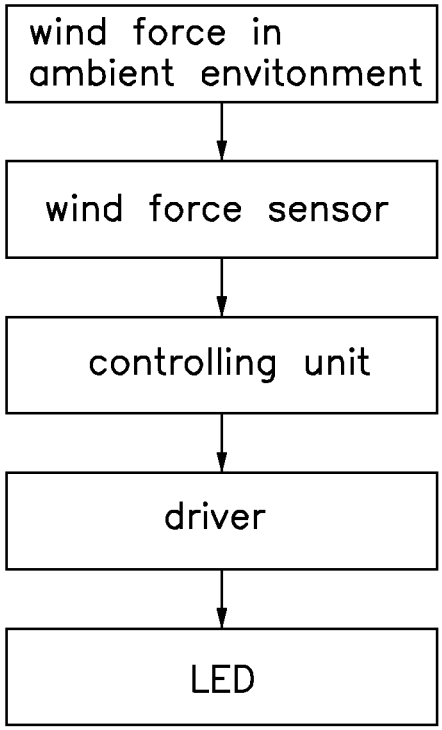
FIG. 2 is a function block diagram of the electronic censer of FIG. 1.
Figure 3:
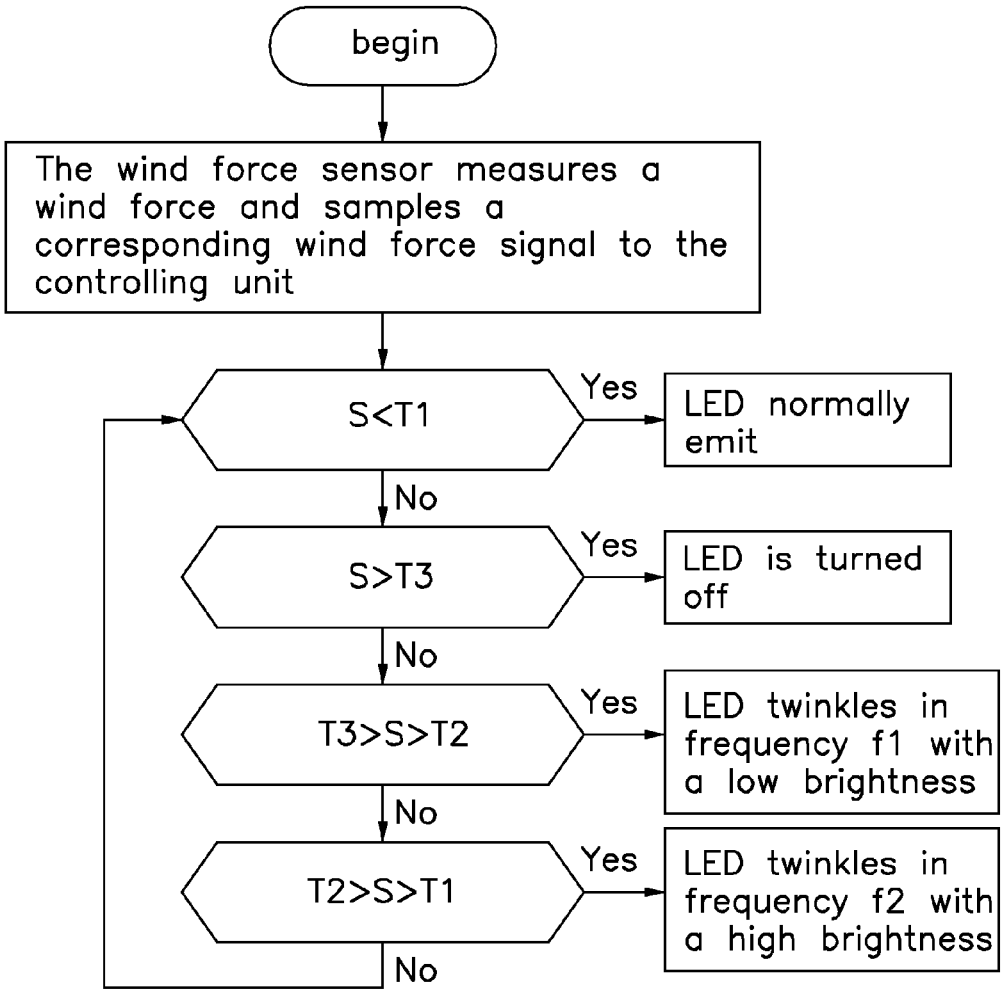
FIG. 3 is a working flow chart of a controlling unit of the electronic censer of FIG. 1.

Referring to FIG. 2 and FIG. 3, when the electronic censer 100 is in use, the LEDs 20 are lighted. The wind force sensor 40 continuously measures the wind force in ambient environment and samples the corresponding wind force signal S to the controlling unit 50. The controlling unit 50 delivers instruction to the driver 30 to regulate the light emitting state of the LEDs 20.

Specifically, a first critical wind force data T1 is stored in the controlling unit 50. When the wind force signal S is smaller than T1, it means that there is no wind or only a very small breeze in ambient environment. Accordingly, the controlling unit 50 delivers a corresponding instruction to the driver 30, and the driver 30 regulates the LEDs 20 to normally emit light without twinkling A brightness of the light generated by each of the LEDs 20 at this situation is defined as a whole brightness.

A third critical wind force data T3 is also stored in the controlling unit 50. T3 is larger than T1. When the wind force signal S is greater than T3, it means that there's heavy wind force in ambient environment. Accordingly, the controlling unit 50 delivers a corresponding instruction to the driver 30, and the driver 30 turns off the LEDs 20.

A second critical wind force T2 data is further stored in the controlling unit 50. T2 is greater than T1 and smaller than T3. When the wind force signal S is greater than T2 and smaller than T3, it means that there is strong wind in ambient environment. Accordingly, the controlling unit 50 delivers a corresponding instruction to the driver 30. The driver 30 regulates the LEDs 20 to quickly twinkle in a high frequency f1, and a brightness of each LED 20 is ranged between zero (i.e., no light) and a half of the whole brightness.

When the wind force signal S is greater than T1 and smaller than T2, it means that there is an ordinary breeze in ambient environment. Accordingly, the controlling unit 50 delivers a corresponding instruction to the driver 30. The driver 30 regulates the LEDs 20 to slowly twinkle in a low frequency f2, and a brightness of each LED 20 is ranged between a half of the whole brightness and the whole brightness. The frequency f2 is smaller than that of f1.

Since the electronic censer 100 includes the control system, the wind force signal S delivered by the wind force sensor 40 is respectively compared to the critical wind force data T1, T2, T3. The controlling unit 50 delivers instruction to the driver 30 and thereby to regulate the light emitting state of the LEDs 20. As such, state of the LEDs 20 can be continuously alternated according to the change of the wind force in ambient environment to thereby simulate the conventional censor to emit light.

Alternatively, the electronic censer with luminance control system can further include a shade (not shown) disposed over a top of the main body 10 and covering the LEDs 20. The wind force sensor 40 can be disposed at the sidewall 13 of the main body 10 and exposed in ambient air.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. An electronic censer with control system comprising:

a hollow main body;

an LED disposed on the main body;

a control system mounted on the main body, the control system comprising a driver received in the main body, a wind force sensor exposed out of the main body, and a controlling unit electrically connecting with the driver, the wind force sensor measuring a wind force therearound, generating a wind force signal S and sending the wind force signal S to the controlling unit, the controlling unit analyzing the wind force signal S and thereby delivering instructions to the driver to regulate a light emitting state of the LED.

2. The electronic censer with control system of claim 1, wherein a plurality of critical wind force data are stored in the controlling unit, the controlling unit analyzing the wind force signal S by comparing the wind force signal S with each of the plurality of critical wind force data to decide the instructions to be delivered to the driver to regulate the light emitting state of the LED.

3. The electronic censer with control system of claim 2, wherein a first critical wind force data T1 is stored in the controlling unit, the driver regulating the LED to normally emit light without twinkling when S is smaller than T1, a brightness of the light emitted by the LED when S is smaller than T1 being defined as a whole brightness.

4. The electronic censer with control system of claim 3, wherein a second critical wind force data T2 is stored in the controlling unit, T2 being greater than T1, the driver turning off the LED when S is greater than T2.

5. The electronic censer with control system of claim 4, wherein a third critical wind force data T3 is stored in the controlling unit, T3 being greater than T1 and smaller than T2, the driver regulating the LED to quickly twinkle in a high frequency when S is greater than T2 and smaller than T1, and a brightness of the LED being ranged between zero and a half of the whole brightness.

6. The electronic censer with control system of claim 5, wherein the driver regulates the LED to slowly twinkle in a low frequency when S is greater than T2 and smaller than T1, and a brightness of the LED being ranged between a half of the whole brightness and the whole brightness.

7. The electronic censer with control system of claim 2, wherein the wind force sensor periodically measures the wind force in ambient environment and sends the wind force signal to the controlling unit.

8. The electronic censer with control system of claim 1, wherein a measure period of the wind force by the wind force sensor is ranged from five seconds to ten seconds.

9. The electronic censer with control system of claim 1, wherein the controlling unit comprises an input portion and an output portion engaged together, the input portion electrically connecting with the wind force sensor, the output portion electrically connecting with the driver.

10. A method for controlling an electronic censer with control system, the electronic censer with control system comprising a main body, an LED disposed on the main body, and a control system mounted on the main body, the control system comprising a driver received in the main body, a wind force sensor exposed out of the main body, and a controlling unit electrically connecting with the driver, the method comprising:

defining a plurality of critical wind force data;

measuring a wind force of ambient environment via the wind force sensor and sampling a corresponding wind force signal S of the measured wind force to the controlling unit;

comparing the wind force signal S with the plurality of critical wind force data via the controlling unit, and thereby delivering instruction to the driver to regulate a light emitting state of the LED.

11. The method for controlling the electronic censer with control system of claim 10, wherein the wind force of ambient environment is periodically measured and sampled to the controlling unit.

12. The method for controlling the electronic censer with control system of claim 10, wherein the plurality of critical wind force data include a first critical wind force data T1 defined in the controlling unit, the LED is regulated by the driver to normally emit light without twinkling when S is smaller than T1, a brightness of the normally emitted light being defined as a whole brightness.

13. The method for controlling the electronic censer with control system of claim 12, wherein the plurality of critical wind force data include a second critical wind force data T2 defined in the controlling unit, T2 being greater than T1, the driver turning off the LED when S is greater than T2.

14. The method for controlling the electronic censer with control system of claim 13, wherein the plurality of critical wind force data include a third critical wind force data T3 defined in the controlling unit, T3 being greater than T1 and smaller than T2, the driver regulating the LED to quickly twinkle in a high frequency when S is greater than T2 and smaller than T1, and a brightness of the LED being ranged between zero and a half of the whole brightness.

15. The method for controlling the electronic censer with control system of claim 14, wherein the driver regulating the LED to slowly twinkle in a low frequency when S is greater than T2 and smaller than T1, and a brightness of light emitting from the LED being ranged between a half of the whole brightness and the whole brightness.

16. The method for controlling the electronic censer with control system of claim 1, wherein a measured period of the sampling is ranged from five seconds to ten seconds.

17. A method for controlling an electronic censer, comprising steps:

defining a plurality of critical wind force data;

measuring a wind force of ambient environment and sampling a wind force signal S corresponding to the measured wind force;

comparing the wind force signal S with the plurality of critical wind force data; and regulating light emitting state of the electronic censer according to compared results of the wind force signal S and the plurality of critical wind force data.

* * * * *